US012747558B2

(12) United States Patent
Kunz et al.

(10) Patent No.: US 12,747,558 B2
(45) Date of Patent: Sep. 29, 2026

(54) DIPPER LIP

(71) Applicant: Caterpillar Inc., Peoria, IL (US)

(72) Inventors: Phillip J. Kunz, Morton, IL (US); James G. Jamilosa, Waipahu, HI (US)

(73) Assignee: Caterpillar Inc., Peoria, IL (US)

( * ) Notice: Subject to any disclaimer, the term of this patent is extended or adjusted under 35 U.S.C. 154(b) by 236 days.

(21) Appl. No.: 18/424,202

(22) Filed: Jan. 26, 2024

(65) Prior Publication Data

US 2024/0167246 A1 May 23, 2024

Related U.S. Application Data

(63) Continuation of application No. 17/360,464, filed on Jun. 28, 2021, now Pat. No. 11,926,987.

(51) Int. Cl.
*E02F 3/40* (2006.01)
*E02F 3/60* (2006.01)

(52) U.S. Cl.
CPC . *E02F 3/40* (2013.01); *E02F 3/60* (2013.01)

(58) Field of Classification Search
CPC ... E02F 3/60; E02F 3/40; E02F 9/2883; E02F 3/4075; E02F 3/304
See application file for complete search history.

(56) References Cited

U.S. PATENT DOCUMENTS 2,724,518 A * 11/1955 Charlton ..... E02F 3/40 37/444
3,014,293 A 12/1961 Boatman et al.
5,063,694 A 11/1991 McCreary, Jr.
5,815,959 A 10/1998 Bahner
6,990,760 B1 * 1/2006 Zaayman ..... E02F 3/36 37/446
8,572,870 B2 11/2013 Kudo
8,997,382 B2 * 4/2015 Gilmore ..... E02F 3/4075 37/445
9,340,949 B2 5/2016 Knuth
9,809,947 B2 * 11/2017 Gross ..... E02F 3/60
9,840,828 B2 * 12/2017 Bierwith ..... E02F 3/40
10,519,621 B2 12/2019 Feld et al.
10,934,682 B2 3/2021 Feld
2012/0279095 A1 * 11/2012 Feld ..... E02F 3/60 37/444

(Continued)

FOREIGN PATENT DOCUMENTS

CA 2985772 A1 * 5/2018 ..... E02F 3/60
CN 102767201 A 11/2012

(Continued)

OTHER PUBLICATIONS

Haihao Group, "What is butt welding?", Jun. 23, 2016, <https://www.weldflange.com/what-is-butt-welding.html> (Year: 2016).*

*Primary Examiner* — Christopher J Sebesta
*Assistant Examiner* — Blake E Scoville

(57) ABSTRACT

A dipper lip includes a first side wing, a second side wing, a rear attachment portion that spans from the first side wing and the second side wing, and a front shovel portion that extends from the first side wing to the second side wing, and the front shovel portion defines a top shovel surface, while the rear attachment portion forms a top rear surface. The top shovel surface forms an obtuse angle with the top rear surface in a midplane of the dipper lip.

20 Claims, 5 Drawing Sheets

(56) References Cited

U.S. PATENT DOCUMENTS

| | | | | |
|---|---|---|---|---|
| 2013/0047475 | A1 | 2/2013 | Bierwith | |
| 2013/0318840 | A1* | 12/2013 | Ollinger, IV | E02F 3/40 37/444 |
| 2016/0153177 | A1 | 6/2016 | Zamorano Jones et al. | |
| 2016/0362873 | A1 | 12/2016 | Campomanes | |
| 2017/0314227 | A1 | 11/2017 | Johnson | |
| 2018/0142447 | A1 | 5/2018 | Popp et al. | |
| 2020/0318321 | A1 | 10/2020 | Kurokawa | |

FOREIGN PATENT DOCUMENTS

| | | | |
|---|---|---|---|
| CN | 105317437 | A | 2/2016 |
| JP | H1161876 | | 3/1999 |
| JP | 2004183396 | | 7/2004 |
| JP | 2007107281 | | 4/2007 |
| JP | 2020012368 | | 1/2020 |

* cited by examiner

DIPPER LIP

CROSS-REFERENCE TO RELATED APPLICATION

This application is a continuation of, and claims priority to, U.S. application Ser. No. 17/360,464, filed on Jun. 28, 2021, the entirety of which is incorporated herein by reference.

TECHNICAL FIELD

The present disclosure relates to dippers used in construction and mining equipment, and the like. Specifically, the present disclosure relates to a dipper that is adapted for use in oilsands applications.

BACKGROUND

In many current applications, dippers are used on heavy equipment such as electric rope shovels and the like. These dippers may become worn or cracked due to the harsh environment in which they are used. Also, the digging performance for these dippers may depend on the type of material being moved.

In particular, oilsands applications are known to require maintenance on dippers due to heel wear and digging performance has proven to be less than desirable. In order to replace the dipper, the dipper must be removed from the machine with worn components being replaced. Alternatively, a whole new dipper is required. This requires undesirable extended downtime for the machine and added cost for the new dipper component(s).

Various dipper configurations are known in the art including the dipper configuration disclosed in U.S. Pat. No. 9,809,947. The '947 patent discloses a dipper for a mining shovel that includes a back wall, a first side wall extending from the back wall, a second side wall extending from the back wall, a front wall disposed opposite the back wall and extending between the first and second side walls, and a dipper door pivotally coupled to a bottom end of the dipper. The dipper door is movable between a latched and an unlatched position relative to the dipper. The dipper door is angled relative to the front wall at an acute angle when the dipper door is in the latched position.

However, nothing in the '947 patent addresses digging performance or preventing heel wear of a dipper in abrasive environment such as an oilsands application.

Accordingly, there is a need to develop a dipper that has a better digging performance, and less heel wear than has heretofore been devised.

SUMMARY

A dipper according to an embodiment of the present disclosure may comprise a top wall, a first side wall extending from the top wall, a second side wall extending from the top wall, a bottom floor extending from the first side wall to the second side wall, and a dipper lip including a front shovel portion. In a midplane that is perpendicular to the top wall and the bottom floor, the front shovel portion may form an external angle with the bottom floor that is greater than 187.5 degrees.

A dipper according to another embodiment of the present disclosure may comprise a top wall, a first side wall extending from the top wall, a second side wall extending from the top wall, and a bottom floor extending from the first side wall to the second side wall. In a midplane that is perpendicular to the top wall and the bottom floor, the bottom floor may form a first acute angle with the top wall that ranges from 5.0 degrees to 15.0 degrees such that the dipper forms a mouth that narrows toward a rear of the dipper.

A dipper lip according to yet another embodiment of the present disclosure may comprise a first side wing, a second side wing, a rear attachment portion that spans from the first side wing and the second side wing, and a front shovel portion that extends from the first side wing to the second side wing. The dipper lip may define a midplane disposed between the first side wing, and the second side wing. Also, the front shovel portion may define a top shovel surface, while the rear attachment portion forms a top rear surface. The top shovel surface may form an obtuse angle with the top rear surface in the midplane.

A dipper according to an embodiment of the present disclosure may comprise a top wall, a first side wall extending from the top wall, a second side wall extending from the top wall, a bottom floor extending from the first side wall to the second side wall, and a dipper lip including a front shovel portion, and a tip attached to the front shovel portion. In a midplane that is perpendicular to the top wall and the bottom floor, the tip may define a bisector that forms an acute angle with the top wall that ranges from 3.0 degrees to 7.0 degrees.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
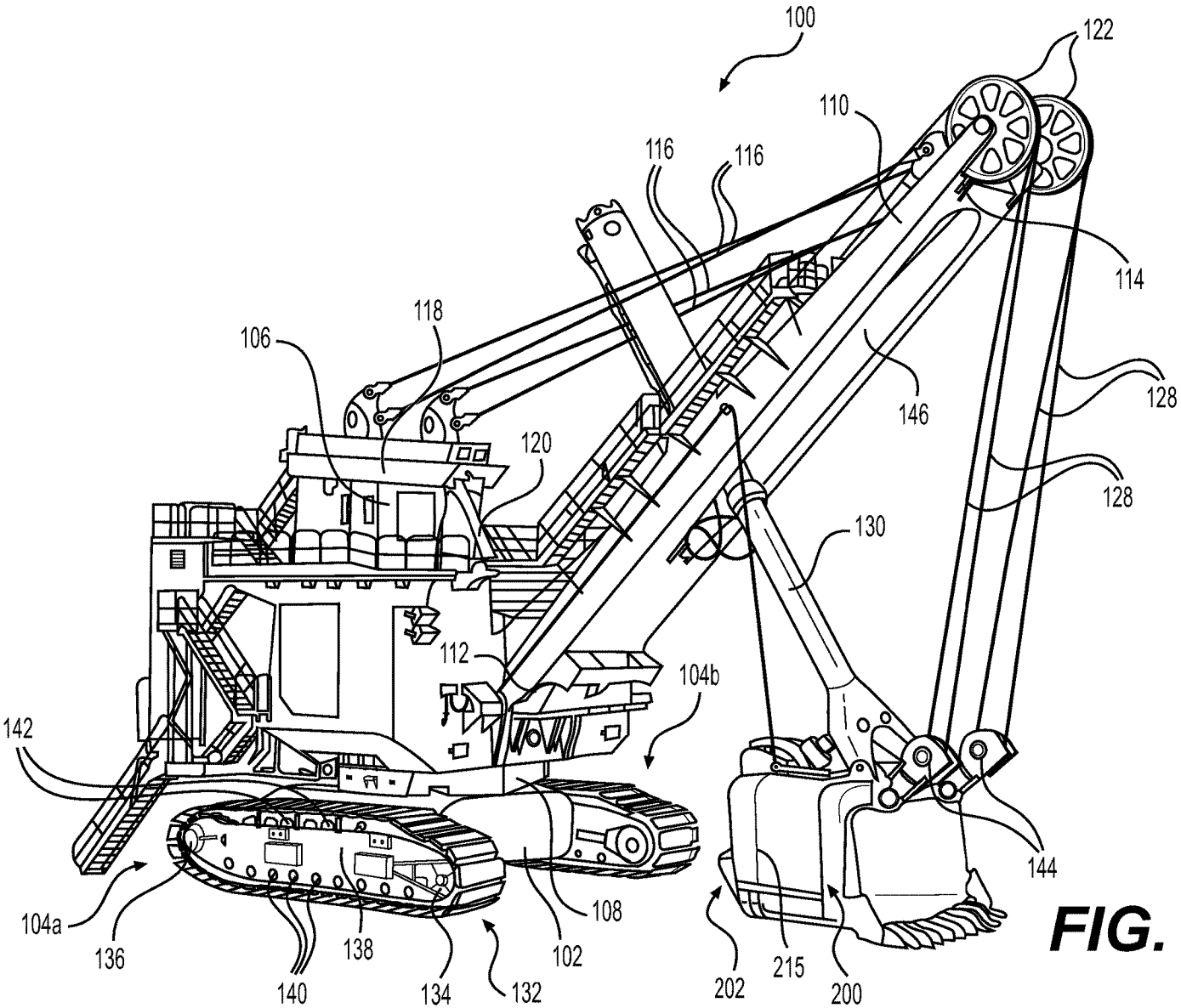
FIG. 1 is a perspective view of a machine such as an electric rope shovel having a dipper that may employ a dipper lip configured according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification.

Various embodiments of the present disclosure include a dipper lip or a dipper that may use various angles to reduce heel wear and/or improve digging performance in abrasive environments such as oilsands applications.

Referring to FIG. 1, there is shown a machine 100 having a carbody 102 (which may include a turntable 108) with a track system including a first track chain 104*a* and a second track chain 104*b* positioned at opposite sides of carbody 102. Machine 100 is shown in the context of an electric rope shovel having an operator cab 106, a boom 110, a lower end 112 of the boom 110 (also called a boom foot), an upper end 114 of the boom 110 (also called a boom point), tension cables 116, a gantry tension member 118, a gantry compression member 120, a sheave 122 rotatably mounted on the upper end 114 of the boom 110, a dipper 200, a dipper door 202 pivotally coupled to the dipper 200, a hoist rope 128, a winch drum (not shown), and a dipper handle 130. An electric motor controls the winch drum, causing the lowering or raising of the boom, dipper, and upward and downward movement of the dipper handle relative to the boom.

Tracks 104*a* and 104*b* are part of a machine undercarriage 132 coupled with carbody 102 in a conventional manner Each of tracks 104*a* and 104*b* include a plurality of coupled together track shoes forming endless loops extending about a plurality of rotatable elements. In a typical design, an idler 134 and a drive sprocket 136 will be associated with each of tracks 104*a* and 104*b* and mounted to a track roller frame 138. A plurality of track rollers 140 may also be mounted to roller frame 138, and are associated with each of tracks 104*a* and 104*b* to support machine 100 and guide tracks 104*a* and 104*b* in desired paths, as further described herein. One or more carrier rollers 142 (or track sliders as will be discussed momentarily herein) may also be associated with each of tracks 104*a* and 104*b* to support and guide the tracks opposite rollers 140 during operation.

The unique design of tracks 104*a* and 104*b* and the overall track and undercarriage system of which they are a part are contemplated to enable machine 100 to operate in certain environments such as oilsands. While use in the machine environment of an electric roper shovel and dipper is emphasized herein, it should be understood that machine 100 might comprise a different type of machine. For instance, track-type tractors or even half-track machines are contemplated herein. Further still, machine 100 might consist of a conveyor or other type of machine wherein tracks are used for purposes other than as ground engaging elements. Also, the machine might be some type of hydraulic shovel, bulldozer, excavator, back hoe, etc.

The dipper 200 is suspended from the boom 110 by the hoist rope 128. The hoist rope 128 is wrapped over the sheave 122 and attached to the dipper 200 at a bail 144. The hoist rope 128 is anchored to the winch drum (not shown). The winch drum is driven by at least one electric motor (not shown) that incorporates a transmission unit (not shown). As the winch drum rotates, the hoist rope 128 is paid out to lower the dipper 200 or pulled in to raise the dipper 200. The dipper handle 130 is also coupled to the dipper 200. The dipper handle 130 is slidably supported in the saddle block 146, and the saddle block 146 is pivotally mounted to the boom 110 at the shipper shaft (not clearly shown). The dipper handle 130 includes a rack and tooth formation thereon that engages a drive pinion (not shown) mounted in the saddle block 146. The drive pinion is driven by an electric motor and transmission unit (not shown) to extend or retract the dipper handle 130 relative to the saddle block 146.

An electrical power source (not shown) is mounted to the carbody 102 to provide power to a hoist electric motor (not shown) for driving the hoist drum, one or more crowd electric motors (not shown) for driving the crowd transmission unit, and one or more swing electric motors (not shown) for turning the turntable 108. In some cases, one electric motor powers all of the moving components of the shovel. Each of the crowd, hoist, and swing motors is driven by its own motor controller, or is alternatively driven in response to control signals from a controller (not clearly shown).

The track chains 104*a* and 104*b* are considered to be well suited for work in hard underfoot conditions. To this end, the track chains 104*a* and 104*b* may be "high ground pressure" tracks, each having track members durable enough to support a relatively large weight of machine 100. Each of track shoe members has a footprint defined in part by front and back edges, and also defined in part by outboard edges and inboard edges. Each of track shoe members may further include a ground contact area that is equal to its footprint, or less than its footprint only to an extent that adjacent track shoes overlap one another or due to voids disposed on the bottom surface of the track shoe member. Other configurations of the track shoes and track chain assemblies are possible in other embodiments of the present disclosure.

Figure 2:
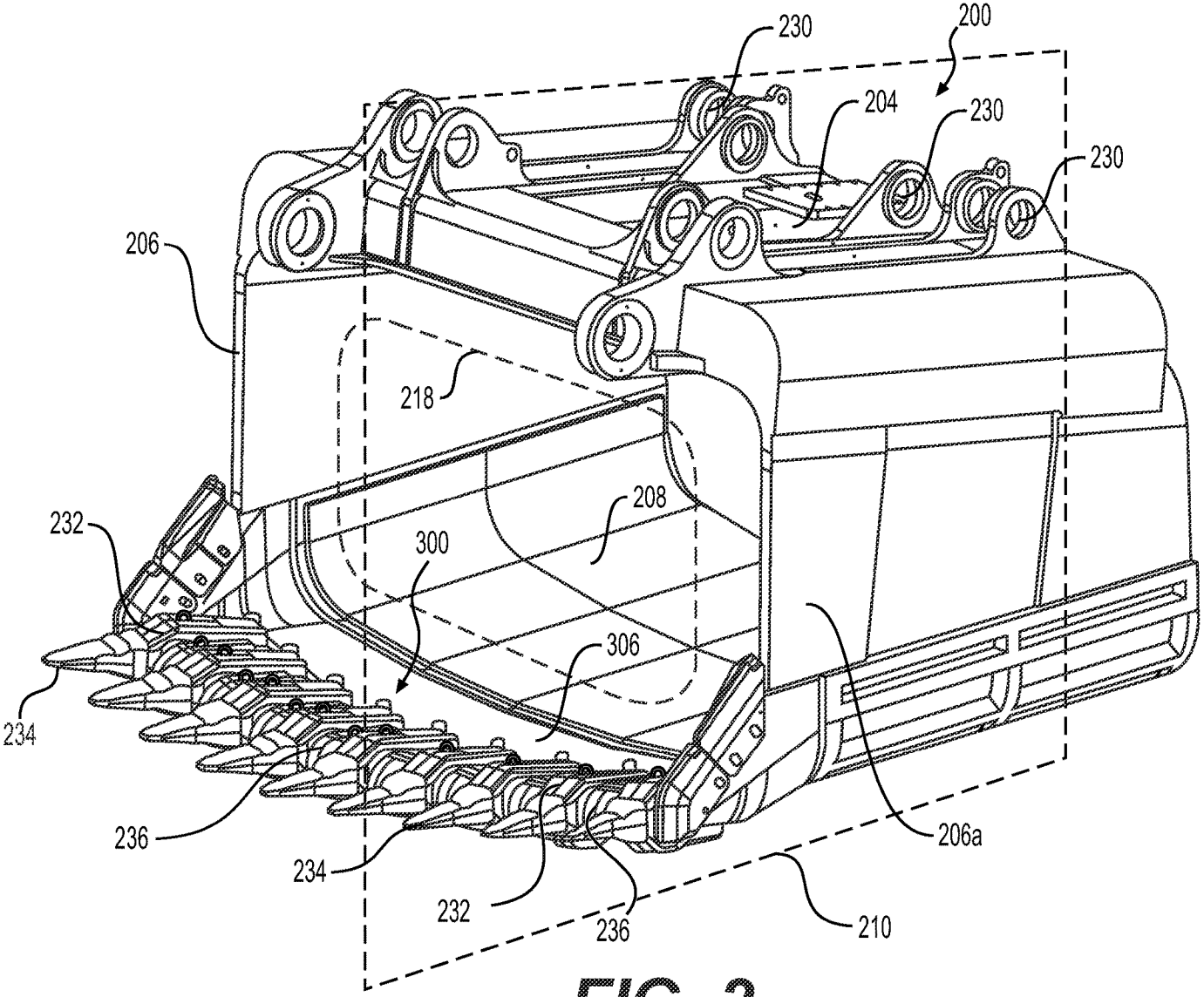
FIG. 2 is a perspective view of the dipper of FIG. 1 removed from the machine.
Figure 3:
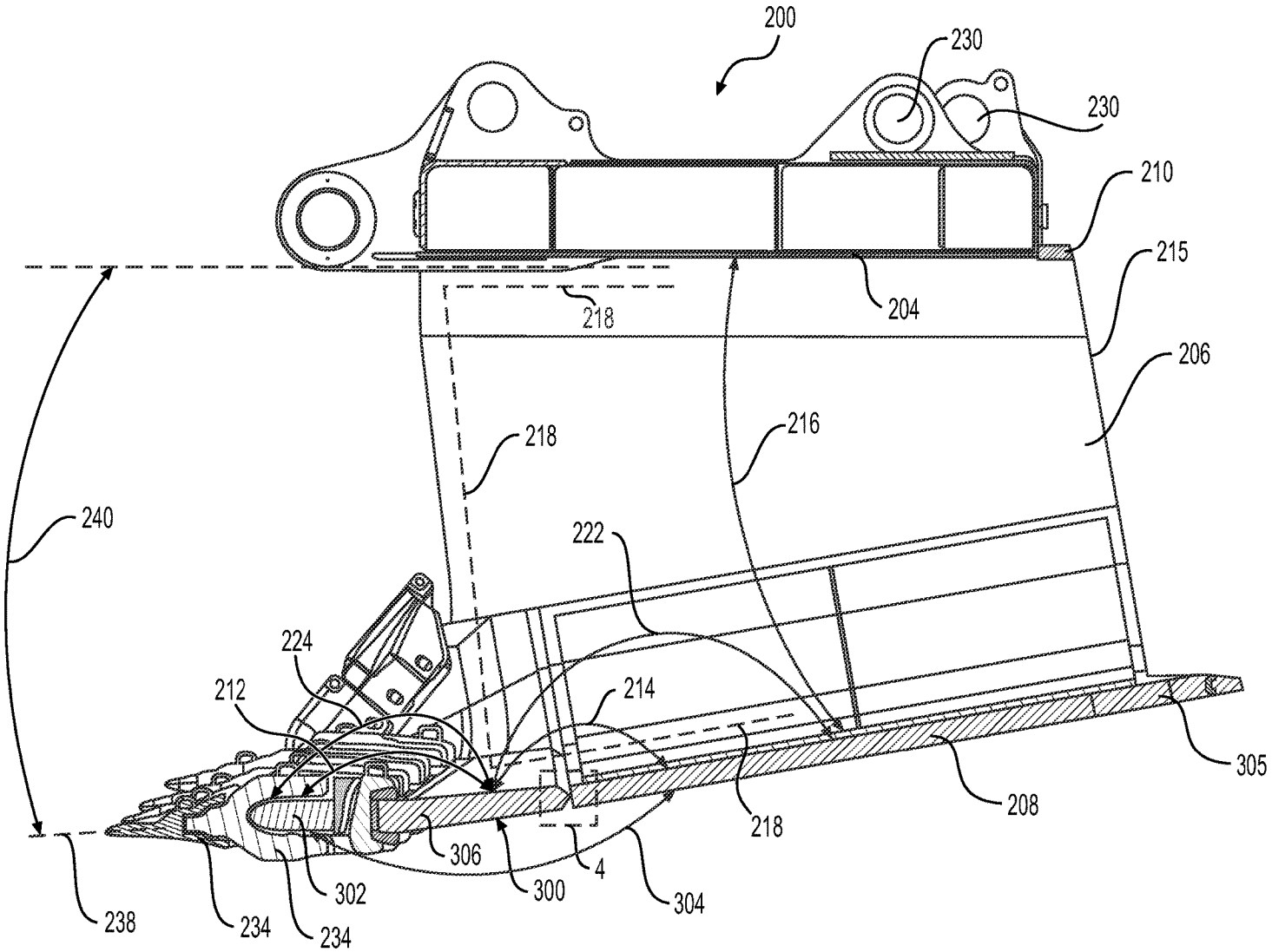
FIG. 3 is side sectional view of the dipper of FIG. 2.

Looking at FIGS. 2 and 3, a dipper bucket according to an embodiment of the present disclosure may comprise a top wall 204, a first side wall 206 extending from the top wall 204, a second side wall 206*a* extending from the top wall 204, and a bottom floor 208 extending from the first side wall 206 to the second side wall 206*a*. A dipper lip 300 may be attached to the bottom floor as well as the side walls. The dipper lip 300 may include a front shovel portion 302 (may also be referred to as a front scoop portion). In some embodiments, this front shovel portion may be essentially horizontal when the top wall is horizontal, improving digging performance.

In a midplane 210 (may also be a plane of symmetry) that is perpendicular to the top wall 204 and the bottom floor 208, the front shovel portion 302 may form an external angle 304 (i.e., this angle is located outside of the dipper) with the bottom floor 208 that is greater than 187.5 degrees. For example, this angle may range from 189.5 degrees to 191.5 degrees (e.g., may actually be about 190.0 degrees to 191.0 degrees) in some embodiments. Providing this angle may reduce the wear on the heel 305 of the dipper. Other angular ranges are possible in other embodiments of the present disclosure.

Also, the dipper lip 300 includes a rear attachment portion 306 (so called since this part of the lip is a rear portion used to attach the lip to the dipper) that forms a first oblique angle 212 with the front shovel portion 302. Similarly, the rear attachment portion 306 of the dipper lip 300 may form a second oblique angle 214 with the bottom floor 208 of the dipper. The first oblique angle may have a slightly different value than the second oblique angle, but not necessarily so.

As best seen in FIG. 3 the top wall 204 of the dipper, and the front shovel portion 302 of the lip are substantially parallel with each other (i.e., +/−2.0 degrees), while the rear edge 215 of the first or the second side wall of the dipper may be substantially perpendicular to the bottom floor 208 of the dipper (i.e., +/−2.0 degrees), but not necessarily so.

Another embodiment of the dipper 300, may be described as follows with continued reference to FIGS. 2 and 3. In the midplane 210, (i.e., the sectioned plane shown in FIG. 3), the bottom floor 208 may form a first acute angle 216 (may be the same as the heel angle) with the top wall 204 that ranges from 5.0 degrees to 15.0 degrees in some embodiments such that the dipper 200 forms a mouth (see dotted lines 218) that narrows toward a rear of the dipper 200.

More specifically, the first acute angle 216 may range from 7.5 degrees to 12.5 degrees in some embodiments of the present disclosure. In other embodiments of the present disclosure, the first acute angle 216 may range from 9.0 degrees to 11.0 degrees (e.g., about 10.0 degrees). Other ranges are possible in other embodiments of the present disclosure.

As alluded to earlier herein, a rear edge 215 may be defined by the top wall 204, the first sidewall 206, and the second sidewall 206*a*. A dipper door 220 (see also FIG. 1) may be pivotally attached to the dipper at the top wall 204 (e.g., at rear pivot points 230 in FIGS. 2 and 3) that is configured to contact the rear edge 215. This may not be the case in other embodiments of the present disclosure.

A front lip (e.g., a dipper lip 300) may also be attached to the dipper including a rear attachment portion 306, and a front shovel portion (e.g., see 302). The rear attachment portion 306 may form a first obtuse angle 222 (see FIG. 3) with the bottom floor 208 on the midplane 210 inside the dipper (i.e. in the interior of the dipper) that ranges from 175.0 degrees to less than 180.0 degrees.

More particularly, the first obtuse angle 222 may range from 176.5 degrees to 178.5 degrees in some embodiments of the present disclosure.

Likewise, the front shovel portion (e.g., see 302) may form a second obtuse angle 224 with the rear attachment portion 306 on the midplane 210 inside the dipper that ranges from 173.0 degrees to 177.0 degrees in some embodiments of the present disclosure. Any of these angular ranges may be different in other embodiments of the present disclosure.

Figure 4:
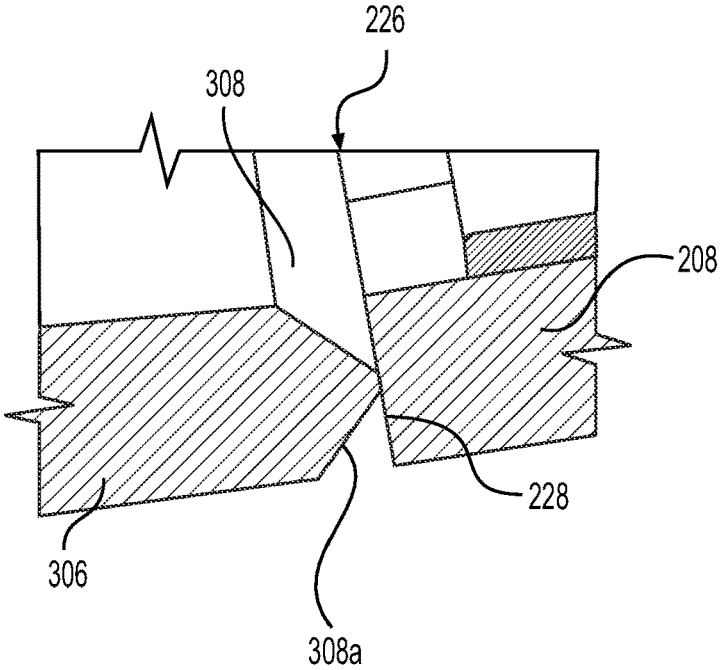
FIG. 4 is an enlarged detail view of the joint formed by the dipper lip and bottom plate of the dipper of FIG. 3.

Looking at FIG. 4, the rear attachment portion 306 of the front lip may form a joint 226 with the bottom floor 208 of the dipper. At this joint 226, the rear attachment portion includes a top chamfer 308, and a bottom chamfer 308*a* disposed at the joint, while the bottom floor may have a flat surface 228 abutting the chamfers. Fillet welds (not shown) may attach these components together, making a rigid joint between these components.

Figure 7:
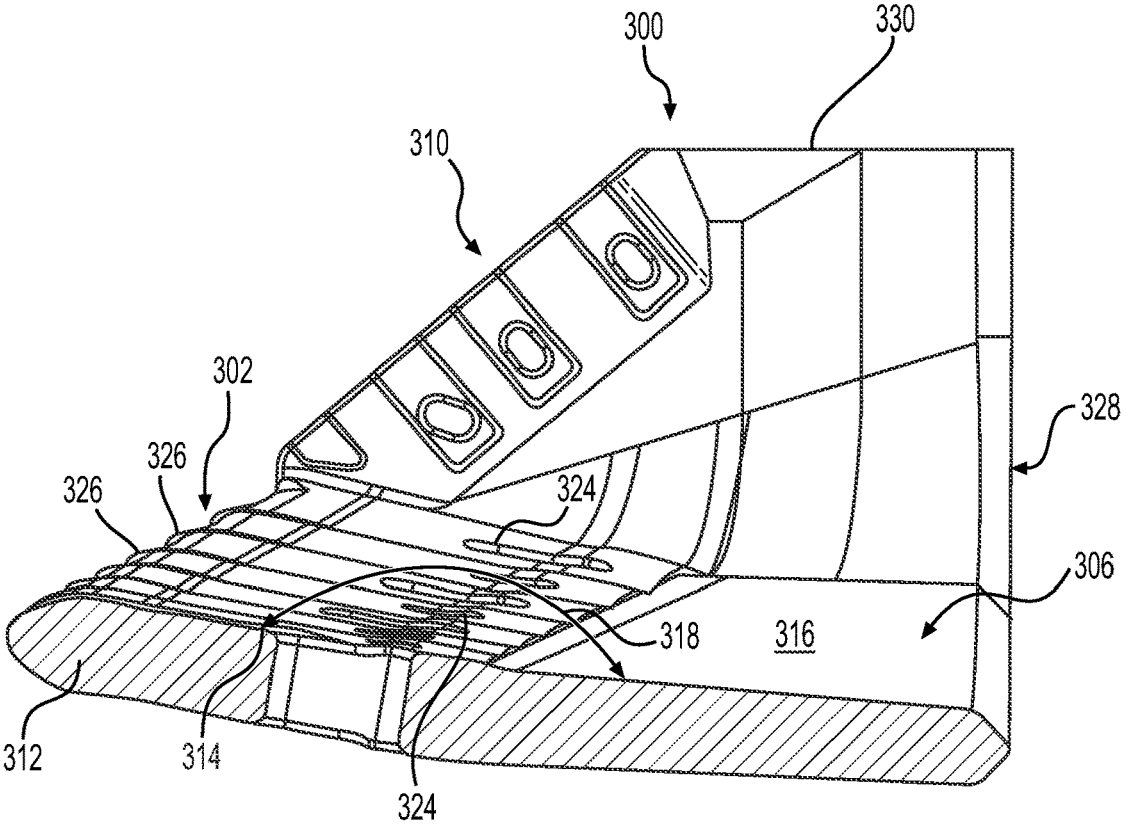
FIG. 7 is a side sectional view of the dipper lip of FIG. 6 taken along lines 7-7 thereof.
Figure 5:
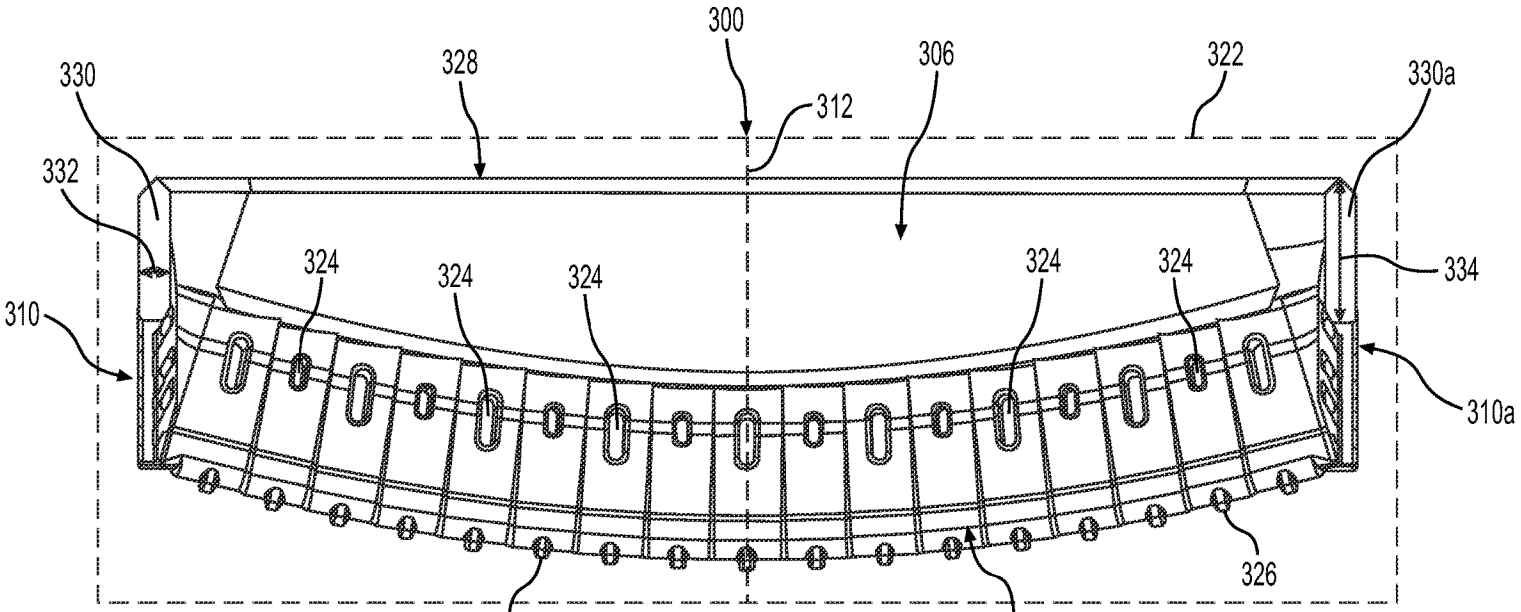
FIG. 5 is a top view of the dipper lip of the dipper of FIGS. 2 and 3 shown in isolation.
Figure 6:
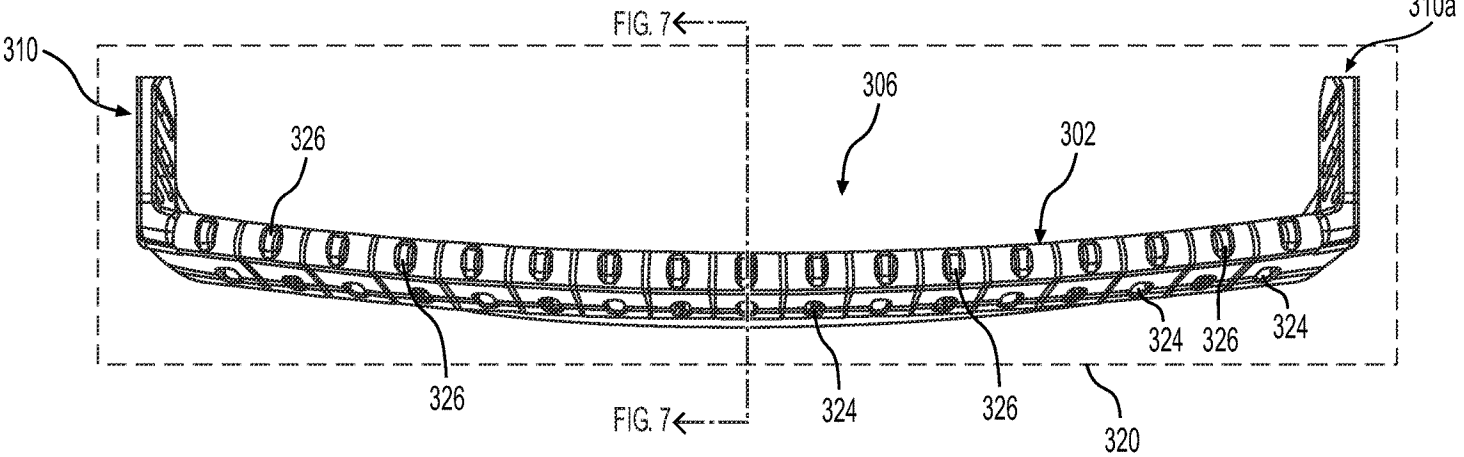
FIG. 6 is a front view of the dipper lip of FIG. 6.

Turning now to FIGS. 5 thru 7, a dipper lip that may be supplied as a replacement part or as a retrofit in the field for a dipper will now be discussed.

Such a dipper lip 300 may comprise a first side wing 310, a second side wing 310*a*, a rear attachment portion 306 that spans from the first side wing 310 to the second side wing 310*a*, and a front shovel portion (e.g., see 302) that extends from the first side wing 310 to the second side wing 310*a*.

The dipper lip 300 may also define a midplane 312 (may be a plane of symmetry as shown but not always) disposed between the first side wing 310, and the second side wing 310*a*. As best seen in FIG. 7, the front shovel portion 302 defines a top shovel surface 314, the rear attachment portion 306 forms a top rear surface 316, and the top shovel surface 314 forms an obtuse angle 318 with the top rear surface 316 in the midplane 312.

In some embodiments of the present disclosure, the obtuse angle 318 may range from 173.0 degrees to 177.0 degrees. In other embodiments of the present disclosure, the obtuse angle 318 may range from 174.0 degrees to 176.0 degrees (e.g., may be about 175.0 degrees).

As seen in FIGS. 5 and 6, the front shovel portion 302 is arcuately shaped in both a vertical plane 320 (dipping parabolic shape shown in FIG. 6) and a horizontal plane 322 (convex arcuate shape shown in FIG. 5). Other configurations are possible in one or both planes other than arcuate, etc.

In FIGS. 5 thru 7, it can be seen that the front shovel portion 302 defines a plurality of vertically extending thru-apertures 324, and a plurality of forwardly extending bosses 326. These facilitate the attachment of adapters 232, teeth 234, and edge protectors 236 (may also be referred to as shrouds) shown in FIGS. 2 and 3. Any of these features or components may be altered or omitted, etc.

As best seen in FIGS. 5 and 7, the rear attachment portion 306 may define a pointed rear edge 328 that extends from the first side wing 310 to the second side wing 310*a*. This edge may be used to allow the dipper lip to be attached to the dipper. This feature may be omitted in other embodiments of the present disclosure.

The first side wing 310 or the second side wing 310*a* may include a top wing surface 330, 330*a* that defines a minimum thickness 332, and an overall length measured perpendicularly to the minimum thickness 332. A ratio of the overall length 334 to the minimum thickness 332 may range from 3.3 to 5.3 in some embodiments of the present disclosure. In some cases, the overall length 334 may range from 495.3 mm to 609.6 mm. This ratio and length may provide enough of a transition between the front shovel portion and the interior of the dipper so that a digging performance improvement and a sturdy attachment are provided simultaneously.

Any of the ratios or dimensions discussed herein may be varied to be different than what has been specifically mentioned in other embodiments of the present disclosure for use in other applications.

In various embodiments of the present disclosure, the dipper lip or other components of the dipper may be made from any suitable materials, such as metal (e.g., cast iron, iron, steel, grey cast-iron, aluminum), reinforced plastic, etc. When metal such as iron or manganese steel is employed, the dipper lip or other component may be cast and machined to final dimensional tolerances.

It should be noted that the description of the dipper lip or other component may omit small blends, fillets, chamfers, etc. When the description of these features is omitted, their presence is to be ignored when interpreting this specification including the claims.

Again, for any of the embodiments discussed herein, the values of dimensions, angles, and ratios may be varied to be different than anything shown or described herein. Also, various features may be modified in configuration or omitted in various embodiments of the present disclosure, etc. Materials of the various components may also be varied as needed or desired to be different.

INDUSTRIAL APPLICABILITY

In practice, a dipper lip, a dipper, and/or any component thereof may be sold, manufactured, bought etc. and in the aftermarket or original equipment scenarios according to any of the embodiments discussed herein. That is to say, the machine may be sold with the dipper, and/or dipper lip, etc. according to embodiments described herein or the machine may be retrofitted, repaired, or refurbished to use any of the embodiments discussed herein. Similarly, any dipper may be retrofit or repaired using a dipper lip according to any embodiment of the present disclosure.

The inventors of the present disclosure have discovered that the embodiments disclosed herein allow the tips or teeth to be rotated up 11° to provide a better the digging performance as compared to previous designs. Also, the back of the lip was rotated up 10° to provide heel wear protection. With the new lip geometry, increased dig performance and virtually no heel wear are expected.

As shown in FIG. 3, the tip or tooth 234 may define a bisector 238 that forms a mouth angle 240 with the top wall 204 that ranges from 3.0 degrees to 7.0 degrees (may be about 5.0 degrees) in some embodiments of the present disclosure. An example tip or tooth 234 may define a longitudinal axis, extending substantially centrally through a distal portion thereof, that forms the mouth angle 240 with the top wall 204.

These design parameters may be critical for obtaining the desired oilsands digging performance and dipper longevity.

While the arrangement is illustrated in connection with an electric rope shovel, the arrangement disclosed herein has universal applicability in various other types of machines commonly employ track systems, as opposed to wheels. The term "machine" may refer to any machine that performs some type of operation associated with an industry such as mining or construction, or any other industry known in the art. For example, the machine may be an excavator, wheel loader, cable shovel, or dragline or the like. Moreover, one or more implements may be connected to the machine. Such implements may be utilized for a variety of tasks, including, for example, lifting and loading.

For any of the embodiments discussed herein, the dipper lip or dipper may be modified to be used on other implements for other machines including other types of buckets.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A dipper lip, comprising:
a first side wing;
a second side wing;
a rear attachment portion that spans from the first side wing to the second side wing; and
a front shovel portion that extends from the first side wing to the second side wing; wherein:
the dipper lip defines a midplane disposed between the first side wing and the second side wing such that the midplane bisects the dipper lip,
the front shovel portion defines a top shovel surface,
the rear attachment portion forms a top rear surface,
the top shovel surface forms an obtuse angle with the top rear surface in the midplane,
in the midplane, the top shovel surface faces the rear attachment portion, and
the obtuse angle ranges between 173.0 degrees and 177.0 degrees.

2. The dipper lip of claim 1, wherein;
the rear attachment portion includes a top chamfer, and a bottom chamfer opposite the top chamfer, and
in the midplane, the top shovel surface faces the top rear surface.

3. The dipper lip of claim 1, wherein the obtuse angle ranges from 174.0 degrees to 176.0 degrees.

4. The dipper lip of claim 1, wherein;
the front shovel portion is arcuately shaped in both a vertical plane and a horizontal plane, and
in the midplane, the top shovel surface extends upward.

5. The dipper lip claim 1, wherein the front shovel portion defines a plurality of vertically extending thru-apertures, and a plurality of forwardly extending bosses.

6. The dipper lip of claim 1, wherein:
the rear attachment portion defines a pointed rear edge that extends from the first side wing to the second side wing, and
in the midplane, the top shovel surface faces a rear of the dipper lip.

7. The dipper lip of claim 1, wherein the first side wing or the second side wing includes a top wing surface that defines a minimum thickness, an overall length measured perpendicularly to the minimum thickness, and a ratio of the overall length to the minimum thickness that ranges from 3.3 to 5.3.

8. The dipper lip of claim 7, wherein the overall length ranges from 495.3 mm to 609.6 mm.

9. A dipper, comprising:
a top wall;
a first side wall extending from the top wall;
a second side wall extending from the top wall;
a bottom floor extending from the first side wall to the second side wall; and
a dipper lip including a front shovel portion and a rear attachment portion, wherein in a midplane defined by the dipper lip that is perpendicular to the top wall and the bottom floor:
the front shovel portion forms an external angle with the bottom floor that is greater than 187.5 degrees,
a top shovel surface of the front shovel portion forms an obtuse angle with a top rear surface of the rear attachment portion, and
the top shovel surface faces the rear attachment portion.

10. The dipper of claim 9, wherein the rear attachment portion forms a first oblique angle with the front shovel portion.

11. The dipper of claim 10, wherein the rear attachment portion of the dipper lip forms a second oblique angle with the bottom floor of the dipper bucket.

12. The dipper of claim 9, wherein the top wall and the front shovel portion are substantially parallel with each other.

13. A dipper, comprising:
a top wall;
a first side wall extending from the top wall;
a second side wall extending from the top wall;

a bottom floor extending from the first side wall to the second side wall; and a dipper lip including a front shovel portion, a rear attachment portion, and a tip attached to the front shovel portion, wherein in a midplane defined by the dipper lip that is perpendicular to the top wall and the bottom floor:

a longitudinal axis extending substantially centrally through a distal portion of the tip, the longitudinal axis forming a mouth angle with the top wall that ranges from 3.0 degrees to 7.0 degrees, a top shovel surface of the front shovel portion forms an obtuse angle with a top rear surface of the rear attachment portion, and the top shovel surface faces the rear attachment portion.

14. The dipper of claim 13, wherein the obtuse angle ranges between 173.0 degrees and 177.0 degrees.

15. The dipper of claim 13, wherein the rear attachment portion of the dipper lip forms a joint with the bottom floor of the dipper, the rear attachment portion including a top chamfer and a bottom chamfer disposed at the joint.

16. The dipper of claim 13, wherein an additional obtuse angle is formed between the rear attachment portion and the bottom floor, and the additional obtuse angle ranges between 175.0 degrees and 180.0 degrees.

17. The dipper of claim 13, wherein an acute angle is formed between the bottom floor and the top wall that ranges from 5.0 degrees and 15.0 degrees.

18. The dipper of claim 13, wherein the dipper lip further includes a first side wing and a second side wing, the front shovel portion extending from the first side wing to the second side wing.

19. The dipper of claim 9, wherein the obtuse angle ranges between 173.0 degrees and 177.0 degrees.

20. The dipper lip of claim 1, wherein the dipper lip comprises a component of a dipper, and the dipper comprises:

a top wall;

a first side wall extending from the top wall;

a second side wall opposite the first side wall; and a bottom floor extending from the first side wall to the second side wall, the dipper lip being connected to the bottom floor.

* * * * *